US007356962B2

(12) United States Patent
Swan

(10) Patent No.: US 7,356,962 B2
(45) Date of Patent: Apr. 15, 2008

(54) LOW PROFILE FLIP UP SITE

(76) Inventor: Richard E. Swan, 230 W. Center St., West Bridgewater, MA (US) 02379

( * ) Notice: Subject to any disclaimer, the term of this patent is extended or adjusted under 35 U.S.C. 154(b) by 440 days.

(21) Appl. No.: 10/939,962

(22) Filed: Sep. 14, 2004

(65) Prior Publication Data

US 2005/0188602 A1 Sep. 1, 2005

Related U.S. Application Data

(60) Provisional application No. 60/511,878, filed on Oct. 16, 2003.

(51) Int. Cl.
*F41A 15/00* (2006.01)

(52) U.S. Cl. ..... 42/147; 42/133; 42/137; 42/138; 42/140; 42/148

(58) Field of Classification Search ..... 42/133, 42/137, 140, 141, 147, 148
See application file for complete search history.

(56) References Cited

U.S. PATENT DOCUMENTS

| | | | | |
|---|---|---|---|---|
| 308,699 | A | 12/1884 | Rabbeth | |
| 396,043 | A * | 1/1889 | Lyman | 42/140 |
| 426,887 | A | 4/1890 | West | |
| 561,360 | A | 6/1896 | Taylor | |
| 564,514 | A | 7/1896 | Fuller | |
| 805,770 | A | 11/1905 | Blenkner | |
| 878,857 | A | 2/1908 | Bevier | |
| 894,755 | A | 7/1908 | Snedden | |
| 1,034,925 | A | 8/1912 | Newitt | |
| 1,089,009 | A * | 3/1914 | Porter | 42/148 |
| 1,257,713 | A | 2/1918 | Johnson | |
| 1,260,907 | A | 3/1918 | Johnson et al. | |
| 1,276,572 | A | 8/1918 | Rogers | |
| 1,602,116 | A | 10/1926 | Manahan et al. | |
| 1,908,019 | A | 5/1933 | Howard | 33/253 |
| 2,032,648 | A | 3/1936 | Bliss | 33/255 |
| 2,093,676 | A | 9/1937 | Hennessy | 33/255 |
| 2,276,446 | A | 3/1942 | Zimmerman | 33/253 |
| 2,331,903 | A | 10/1943 | Garand | 33/253 |
| 2,334,300 | A | 11/1943 | Williams | 33/253 |
| 2,437,363 | A * | 3/1948 | Smith | 42/140 |
| 2,444,038 | A | 6/1948 | Garand | |
| 2,724,897 | A | 11/1955 | Hough | 33/253 |
| 2,939,217 | A | 6/1960 | Hajek | 33/252 |

(Continued)

FOREIGN PATENT DOCUMENTS

| | | |
|---|---|---|
| DE | 151669 | 6/1904 |
| GB | 169397 | 9/1921 |

*Primary Examiner*—Michelle Clement
(74) *Attorney, Agent, or Firm*—Barlow, Josephs & Holmes, Ltd.

(57) ABSTRACT

A low profile, self-aligning, flip-up mechanism for aiming devices used with firearms. The mechanism folds the aiming device into the contour of the firearm during non-use. The mechanism is spring-loaded and flips into a vertical operational position with a simple movement of a finger or thumb. The mechanism includes at least two separate aiming elements that are mounted in a fashion that allows them to rotate relative to one another thereby facilitating a smaller storage profile. The mechanism also causes the aiming device to self-align itself as it moves into an operational position assuring vertical position repeatability.

4 Claims, 8 Drawing Sheets

U.S. PATENT DOCUMENTS

| | | | | |
|---|---|---|---|---|
| 3,930,316 | A * | 1/1976 | Tellie | 42/140 |
| 4,597,211 | A | 7/1986 | Miles | 42/1 S |
| 4,665,622 | A | 5/1987 | Idan | 33/241 |
| 4,691,442 | A * | 9/1987 | Center | 42/140 |
| 5,533,292 | A | 7/1996 | Swan | 42/100 |
| 6,490,822 | B1 * | 12/2002 | Swan | 42/71.01 |
| 6,568,118 | B1 * | 5/2003 | Teetzel | 42/105 |
| 6,606,813 | B1 * | 8/2003 | Squire et al. | 42/90 |
| 6,615,530 | B2 * | 9/2003 | Johansson | 42/133 |
| 6,622,415 | B1 * | 9/2003 | Canaday et al. | 42/140 |
| 6,722,075 | B1 * | 4/2004 | Gabaldon | 42/141 |
| 6,732,467 | B1 * | 5/2004 | Luth | 42/138 |
| 6,779,290 | B1 * | 8/2004 | Houtsma | 42/148 |
| 6,968,643 | B2 * | 11/2005 | Woodbury | 42/137 |
| 7,076,907 | B2 * | 7/2006 | Nesseth et al. | 42/140 |
| D526,380 | S * | 8/2006 | Swan | D22/109 |
| 7,181,882 | B2 * | 2/2007 | Woodbury | 42/137 |
| 2003/0140546 | A1 * | 7/2003 | Kay | 42/133 |

* cited by examiner

LOW PROFILE FLIP UP SITE

CROSS-REFERENCE TO RELATED APPLICATIONS

This application is related to and claims priority from earlier filed U.S. Provisional Patent Application No. 60/511,878, filed Oct. 16, 2003, the contents of which are fully incorporated herein by reference.

BACKGROUND OF THE INVENTION

The present invention relates generally to modular sighting devices for weapons. More specifically, the present invention relates to a low profile configuration for a for providing a flip-up type sighting mechanism that folds down onto the firearm in a compact manner to prevent damage or snagging when not in use.

Generally, sighting mechanisms for firearms are bulky and protrude outside the firearm's general contour. This construction creates a greater opportunity for the sighting mechanism to be caught on clothing or brush while the fire arm is being carried thereby knocking the sighting mechanism out of alignment. Prior art devices that have attempted to address this problem by allowing removal of the sighting mechanism or providing a hinged attachment of the sighting mechanism. Generally, however, the prior art devices require that each time the sighting mechanism is moved into the active position, the sighting mechanism must be re-aligned before it is ready for use. Although this re-alignment step may be acceptable when the firearm is used in a controlled environment such as a firing range, it is not acceptable for a firearm employed for field use, such as hunting or combat environments where immediate, fully aligned use of the sight is required.

This is of particular concern in the field of combat firearms. A firearm that is used in the field requires a sighting mechanism that is located out of the way during times of non-use, thereby providing a streamlined profile that is not likely to be bumped or jarred out of alignment. Further, the sight must be quickly engageable when the firearm is urgently needed. The readiness time for the sighting mechanism to move from the non-use or down position to the use or up position must be minimized. Additionally, when moved from the down position to the up position, the sight must be fully and accurately aligned. It is critical that the sighting mechanism have the ability to be consistently and quickly engaged, and provide accurate aiming. Further, the sight must maintain as small profile as possible when in the retracted storage position to prevent bumping or jarring of the sight.

In prior art devices such as disclosed in U.S. Pat. No. 5,533,292, issued to Swan, a self-aligning flip-up sight is provided that provides a sighting mechanism that can be easily moved from a storage position to an active position without requiring re-alignment of the sights. However, this device has a relatively large vertical profile, even when it is in the retracted position. The large profile results from the use of two iron peep sights mounted fixedly at a 90° angle relative to one another. In order for the sighting mechanism to be moved into the storage position, the iron sight must be placed into a position that allows one of the legs of the iron sight assembly to lie parallel to the firearm with the other leg pointing upwardly. If the iron sight assembly is not in this position, the mechanism cannot be moved into the storage position. Further, when the iron sight assembly is in the proper storage position, one of the legs extends upwardly from the upper surface of the firearm thereby requiring that the protective shoulders of the sighting mechanism extend a sufficient distance to protect this protruding leg of the iron sight. In this manner, the sighting mechanism has a profile that is larger than desired to allow the mounting of additional accessories if desired. Specifically, if a user wished to mount an optical telescopic sight in addition to the retractable sight, an additional spacer would be necessary to allow the required clearance.

In view of the foregoing disadvantages inherent in the prior art devices, there is a need for a device that provides an improved method of compacting and activating optical and iron sight sighting device. There is a further need for a sighting mechanism that provides improved engagement method for firearms sighting devices which has the ability to consistently and quickly engage, and provide accurate aiming, while providing a reduced profile in the storage position thereby reducing potential interference with other ancillary aiming devices and attachments.

BRIEF SUMMARY OF THE INVENTION

In this regard, the present invention provides for a low-profile self-aligning flip-up sight. The present invention sighting device folds downwardly against a mounting rail either directly on the fire arm, onto a receiver sleeve mounting area or other desirable location, thereby keeping the sighting device within the firearm's contour during non-use and streamlining the profile of a weapon. The sighting device is spring-loaded and flips into an operational position with a simple movement of a finger or thumb. The device includes a pair of iron sights that are also pivotally mounted relative to one another allowing them to fold against one another in the retracted position while moving into a position wherein the two sighting elements are oriented at a substantially 90° angle in the deployed position. Further, the present invention sighting device self-aligns itself as it moves into an operational position, thereby providing accurate and consistent aiming while eliminating the need for re-alignment each time the sight is deployed.

The present invention is particularly suited for iron sight type sighting devices. The sighting device includes two iron sight elements, one having a large aperture and one having a small aperture. In the prior art, when two iron sights were provided they were rigidly mounted perpendicular to one another. The sight was then selectibly positionable so that one or the other of the two iron sights was in the operative position while the other sight was positioned out of the way in a position that was substantially parallel to the barrel of the firearm. However as noted above, when utilized in a flip-up type sighting mechanism, if the sight was positioned in the wrong manner, one of the iron sight elements would prevent the sighting mechanism from closing. Even when positioned in the proper alignment, extended shoulders were required to protect the protruding top arm of the sight from impact. To resolve this issue the present invention provides that the two iron sights are mounted so as to be pivotably movable relative to one another.

The present invention is a flip-up sight and is comprised of three major components namely, a base, an alignment member and a sight housing. The sight housing contains the actual aiming system in the form of collapsible iron sights. The aiming system is comprised of two independent legs pivotally mounted on a central sight adjustment screw positioned within the sight housing. The two legs cooperate to form a collapsible aiming system. Each leg includes a circular aiming peep sight, one sight being larger than the other. In the deployed position, the leg with the larger aperture is always in the upright position, the leg with the smaller aperture can be rotated approximately 90° around the sight adjustment screw and is configured to be retained in one of two selected positions. Accordingly, when the large aperture sight is desired the small aperture sight can be folded down out of the way of the large aperture. Further, when the sight housing is placed into the stored position, folded down against the base, the two legs of the aiming system can fold against one another allowing the sight housing to store tightly against the base while preventing one of the sighting elements from protruding outwardly from the firearm.

Accordingly, it is an object of the present invention to provide a sighting mechanism for a firearm that includes at least two aiming elements and has a compact profile when placed into a storage position. It is a further object of the present invention to provide a sighting mechanism for a firearm that can be retracted to a low profile storage position against the contour of the firearm while being quickly and easily deployable to a fully aligned active position. It is yet a further object of the present invention to provide a retractable sighting assembly for a firearm that includes at least two user selectable aiming elements that can be fully retracted into a low profile storage position against the contour of the firearm.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
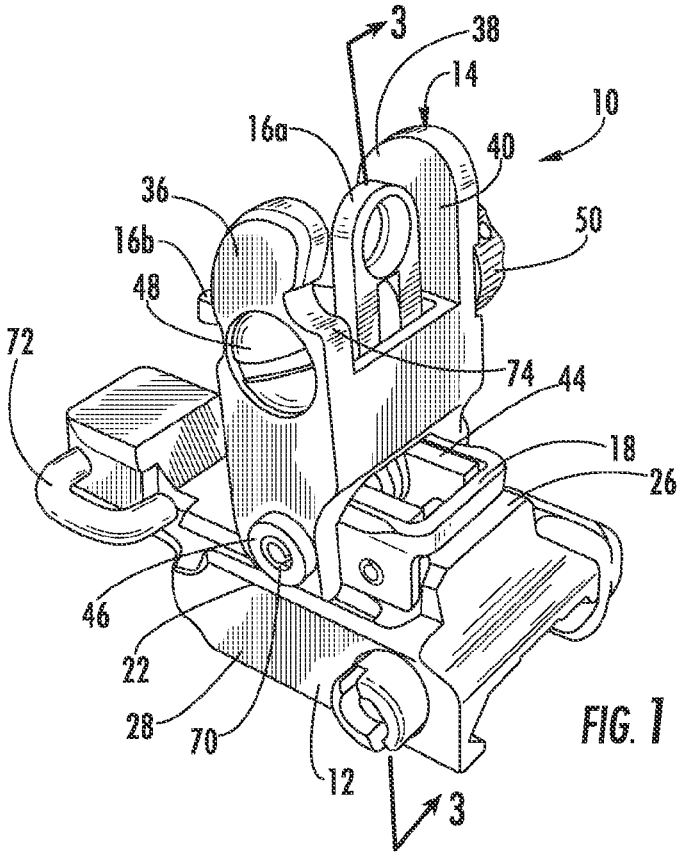
FIG. 1 is a front perspective view of the flip up sight of the present invention in the deployed position with the large aperture aiming element in the active position.

Now referring to the drawings, the retractable flip-up sighting device of the present invention is shown and generally illustrated in the figures as 10. In particular, the present invention is a retractable flip-up sight 10 for a fire arm wherein the flip-up sight 10 has a reduced profile when in the retracted position. This feature allows improved shielding and protection of the aiming elements within the sighting device 10 when in the retracted storage position. Further, the sighting device 10 includes a self-aligning feature that ensures that the sighting elements remain in proper alignment with the firearm each time the sighting elements are deployed into the active position from the storage position. The flip-up sight assembly includes three major components: a base 12, a sight housing 14, and an aiming device 16. Further, to facilitate the self-aligning feature, the sighting device 10 includes an alignment member 18. The sight housing 14 serves to contain and support the actual aiming device 16 while also including features to protect the aiming device 16. The sighting device 10 is designed to be mounted preferably on a Swan universal receiver sleeve, extended rigid frame receiver sleeve, or any other attachment device such as the receiver rail that is attached on the top of a firearm upper receiver. Additionally, the sighting device 10 may be used in place of or in conjunction with most conventional firearm sighting mechanisms.

Turning now to FIG. 1, the base 12 is formed to include an interface means 20 to allow the sighting mechanism 10 to be mounted onto a variety of firearms. The base has 12 an upper surface 22 and a lower surface 24, wherein the lower surface 24 has a cross-sectional profile that is configured to interface with the dovetailed shape of a typical receiver sleeve. The base 12 also includes a right side 26, a left side 28, a front 30 and rear 32 wherein the right side 26 and left side 28 include lower interface members 20 for retaining the sighting mechanism 10 on a receiver sleeve. Two identical, vertical and parallel mounting tabs 34 extend perpendicularly upward from the base 12 upper surface 22. The tabs 34 are thin, have a rectangular shape and lie in vertical parallel planes a predetermined distance apart. The tab 34 planes are parallel to the base 12 sides 26, 28. A spring trough resides between the tabs 34. The width of the trough is defined by the separation between the tabs 34. Each of the mounting tabs 34 includes a mounting pin hole with a common center on an aligned axis perpendicular to the axis of the base 12.

The sight housing 14 has two parallel side plates, a catch plate 36 and an adjustment plate 38, positioned in vertical planes. The sight housing 14 is further defined by an upper support region 40 between the catch plate 36 and the adjustment plate 38. The upper support region 40 is configured to retain and protect the aiming elements 16*a*, 16*b*. The sight housing 14 also includes a lower interface region 42 which includes an inside surface bounded by the catch plate 36, the adjustment plate 38 and further may include alignment surfaces 44 to enable the self alignment feature of the present invention as will be described in detail below. The catch plate 36 and the adjustment plate 38 have holes 46 in the lower interface region 42 thereof, the holes 46 corresponding to the mounting pin holes in the tabs 32 on the base 12.

The aiming elements 16*a*, 16*b* include at least one sighting device such as for example an open iron type peep sight having an aperture therein. Similarly, the aiming elements 16*a*, 16*b* could include any conceivable aiming device such as a magnifying sight or an open sight. As shown in the FIGS., the aiming elements include preferably two different aiming elements such as a large aperture iron sight 16*a* and a small aperture iron sight 16*b*. Similarly, the present invention may include 3 or more aiming elements 16 and fall within the scope of the present invention. The aiming elements 16 each include a top aiming end and a bottom mounting end, whereby the aiming elements 16 are mounted into the upper support region 40 of the sight housing 14. The aiming elements 16 are mounted on and retained in the upper support region 40 of the sight housing 14 by the sight adjustment screw 48 that is positioned and attached between the catch plate 36 and the adjustment plate 38. Referring to FIG. 1, the bottom mounting end of aiming element 16*a* includes spaced mounting legs, while the bottom mounting end of aiming element 16*b* has a single leg that is positioned between the spaced mounting legs of element 16*a*. An arced spring 41 is attached along the bottom of the upper support region 40 and applies pressure against the bottom edge of the aiming elements 16 thereby allowing element 16*b* to rotate independently of element 16*a* approximately 90 degrees around the sight adjustment screw 48 and hold in the desired position by engaging one of two detents 43 (see FIGS. 3A and 3B). A sight adjustment knob 50 is attached to one end of the sight adjustment screw 48 wherein the aiming elements 16 are adapted to be moved laterally across the shaft 49 of the sight adjustment screw 48 as the sight adjustment knob 50 is turned, allowing fine tune adjustment of the aiming elements 16 for compensation in alignment with the firearm as well as windage adjustment.

Figure 2:
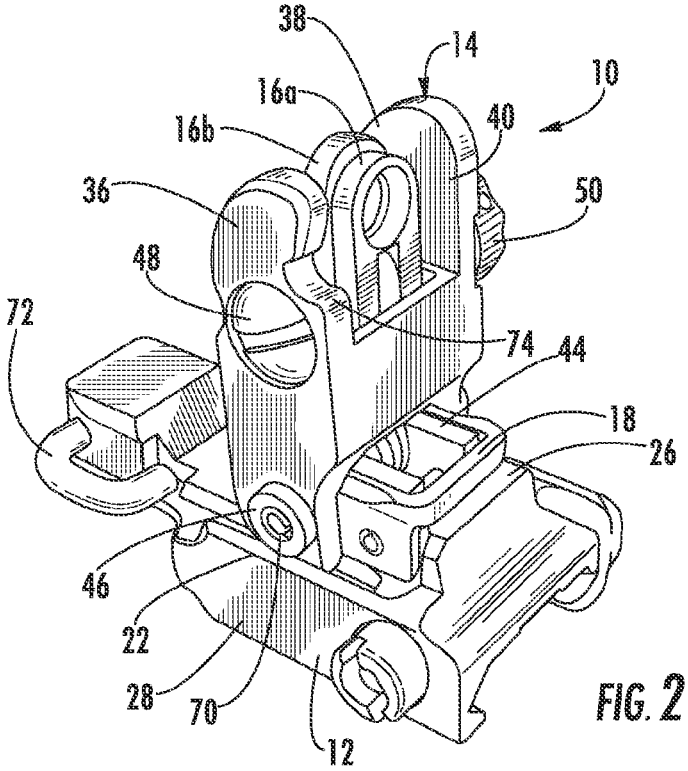
FIG. 2 is a front perspective view of the flip up sight of the present invention in the deployed position with the small aperture aiming element in the active position.
Figure 1A:
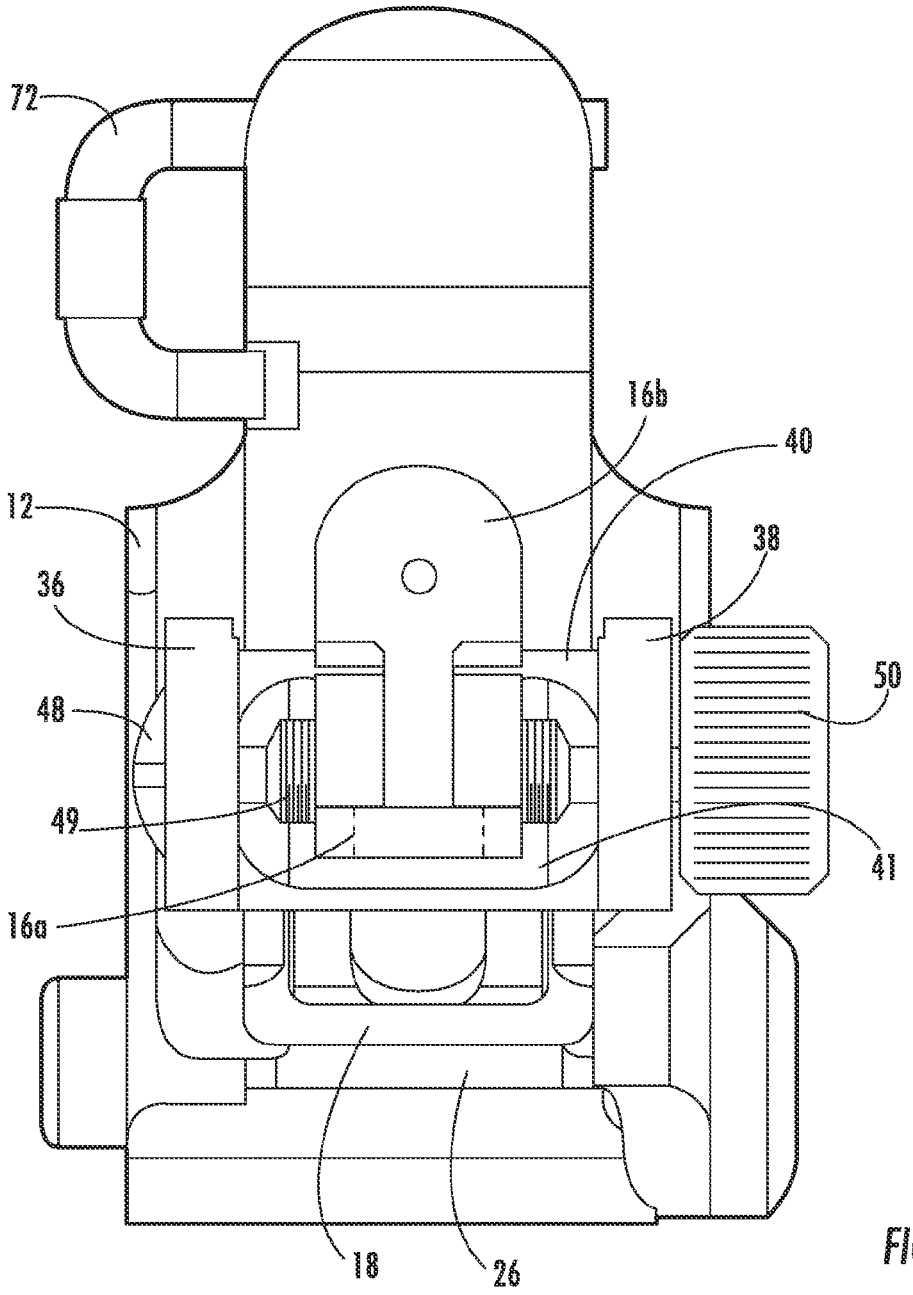
FIG. 1A is a top view thereof.
Figure 5:
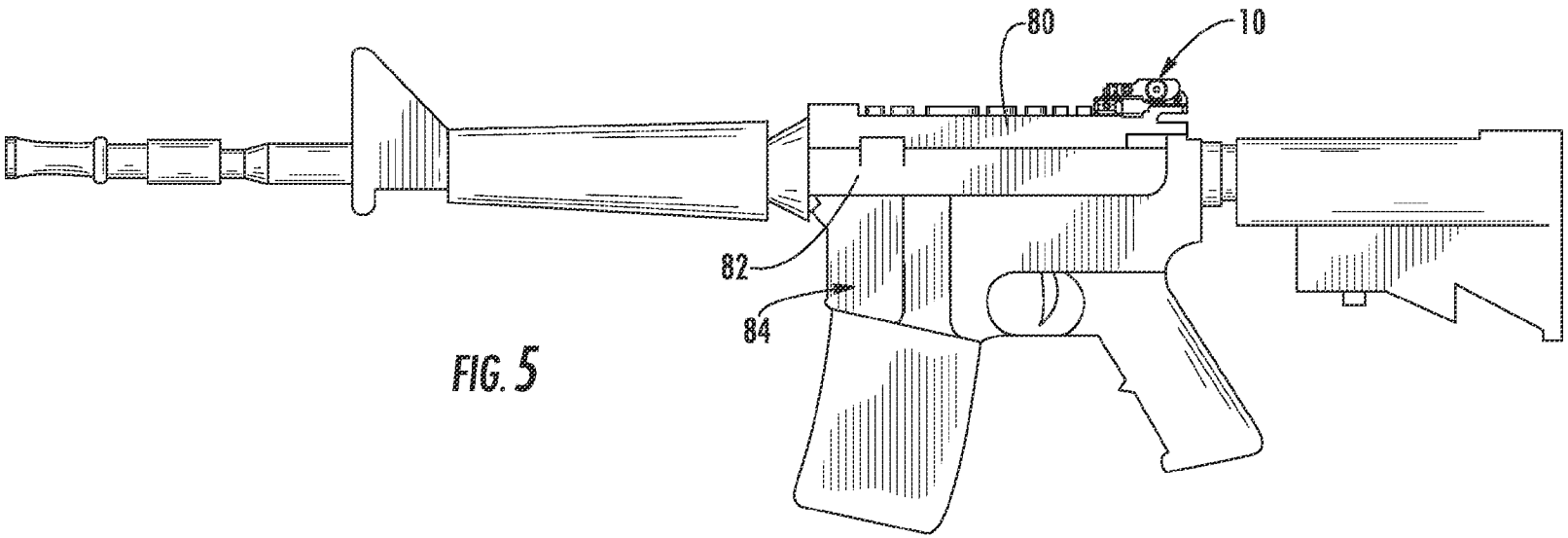
FIG. 5 is a firearm with the flip up sight assembly in the retracted position mounted on the receiver thereof.

As can be seen by viewing FIG. 1 in conjunction with FIG. 2, multiple aiming elements 16 can be used in the sight housing 14 in conjunction with one another. In FIG. 1, the active aiming element 16*a* is a large aperture iron sight and is in the up or active position. The inactive element is a small aperture iron sight 16*b* and is shown folded downwardly in the inactive position. In FIG. 2, the small aperture iron sight 16*b* is shown in the up position against the large aperture iron sight 16*a*. In this position the small aperture iron sight 16*a* is the active sight because when looking through the aiming elements 16 the only aperture through which the user can aim the firearm is the small aperture because the rest of the small aperture aiming element partially blocks the large aperture. Further, as will be more fully discussed later, both aiming elements 16 would be positioned in this manner when the sight housing 14 is placed into the retraced storage position. It should be also appreciated, as can be seen in FIG. 5, that the relative positioning of the aiming elements 16 may be reversed placing the small aperture aiming element 16*b* in the rear position closest to the user and the large aperture aiming element 16*a* in the front position without departing from the disclosure of the present invention. Further, a third or more aiming elements 16 could be added as well and still reside within the present disclosure.

Figure 6:
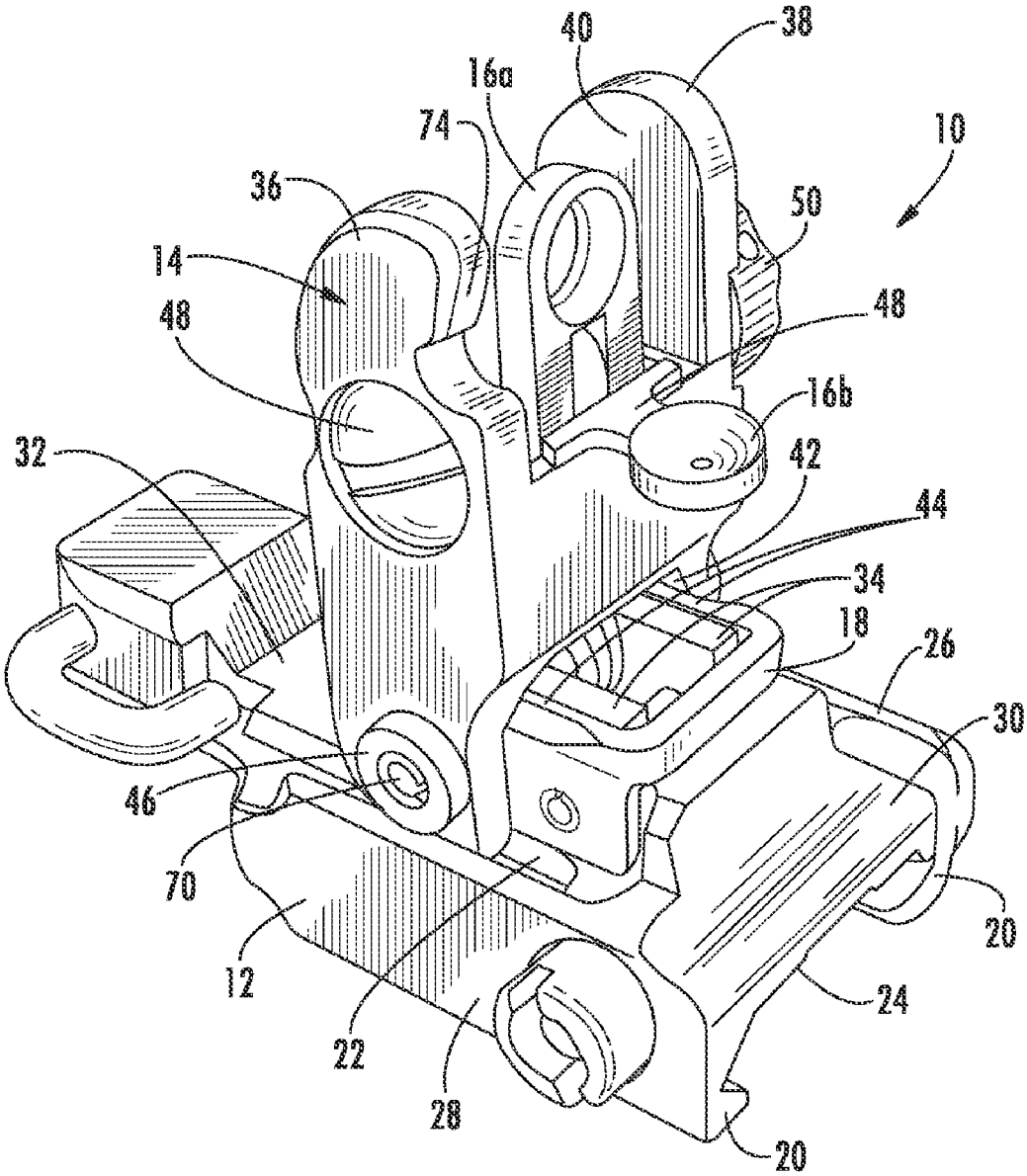
FIG. 6 is a perspective view of the flip up sight in the deployed position with the sighting elements reversed and the large aperture aiming element in the active position.
Figure 7:
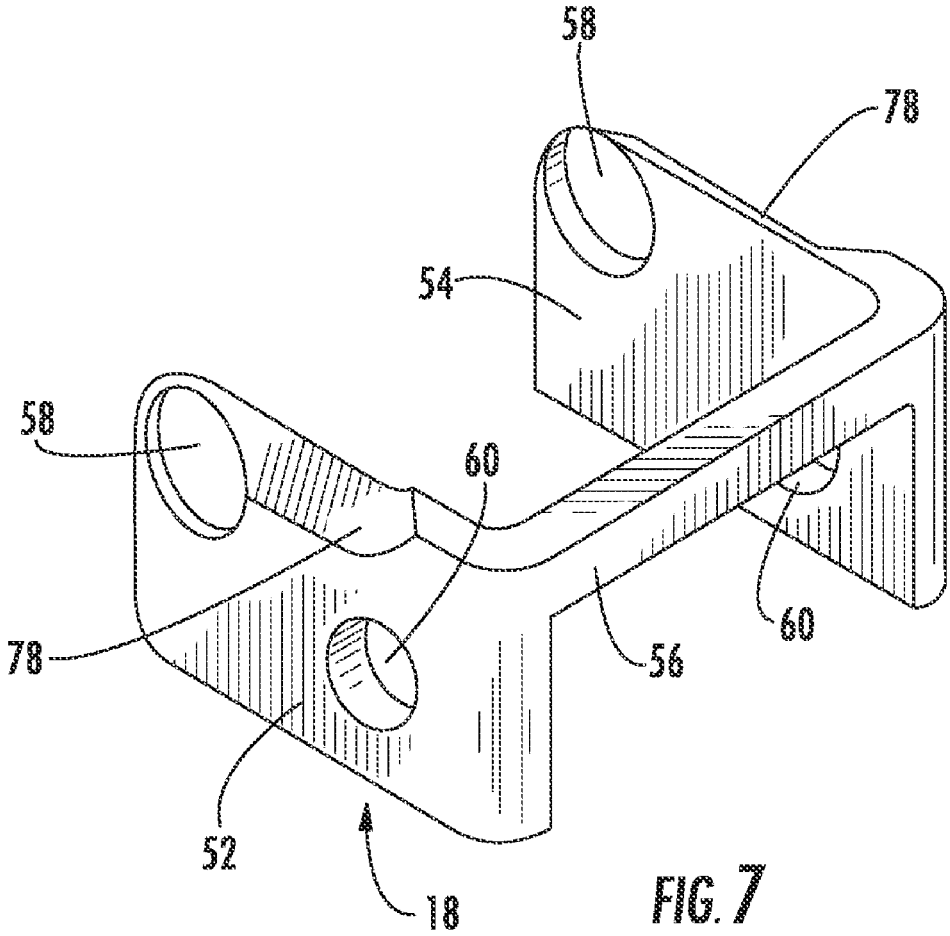
FIG. 7 is a perspective view of the alignment member.

Referring now to FIG. 6, the U-shaped alignment member 18 has two vertical sides 52, 54 and a front face 56. The vertical sides 52, 54 have inner surfaces that are parallel to one another and an outwardly chamfered top edge. The vertical sides 52, 54 each have a mounting pin hole 58 located in their rearward upper quadrants perpendicular to the inner faces wherein when the alignment member 18 is installed onto the base member 12, the mounting pin hole 58 in the vertical sides corresponds to the mounting pin holes in the tabs 34 on the base 12. In this manner when the alignment member 18 is installed onto the base 12 the inner faces of the vertical sides 52, 54 rest against the tabs 34 with the mounting pin holes in the tabs 34 being in alignment with the mounting pin holes 58 in the vertical sides 52, 54 of the alignment member 18. To further assist in retaining the alignment member 18 on the base 12, additional holes 60 are provided in both the alignment member 18 and the tabs 34 on the base 12 where by a spring pin is installed through the common spring pin holes 60 to retain the alignment member 18 and the base 12 in assembled relation. Alternatively, other fasteners such as bolts or rivets could be used and still fall within the scope of the present invention.

Turning back now to FIG. 1, the sighting device 10 of the present invention is shown in the deployed or "open" position, the sight housing 14 lower interface region 42 is positioned over the outer faces of the vertical sides 52, 54 of the U-shaped alignment member 18 such that the mounting pin holes in the in the side walls of the sight housing 14 share a common center with the mounting pin hole in the alignment member 18 and the mounting pin hole in the mounting tabs 34. A mounting spring pin 70 is then inserted into the mounting pin hole thereby attaching the sight housing 14, U-shaped alignment member 18 and the mounting tabs 34 together. Accordingly, the sight housing 14 is pivotally attached by the mounting spring pin 70 to the alignment member 18 and the mounting tabs 34 such that the sight housing 14 can rotate about the mounting spring pin 70 a predetermined amount. Alternatively, other fasteners such as bolts or rivets could be used in place of the mounting spring pin.

Figure 3:
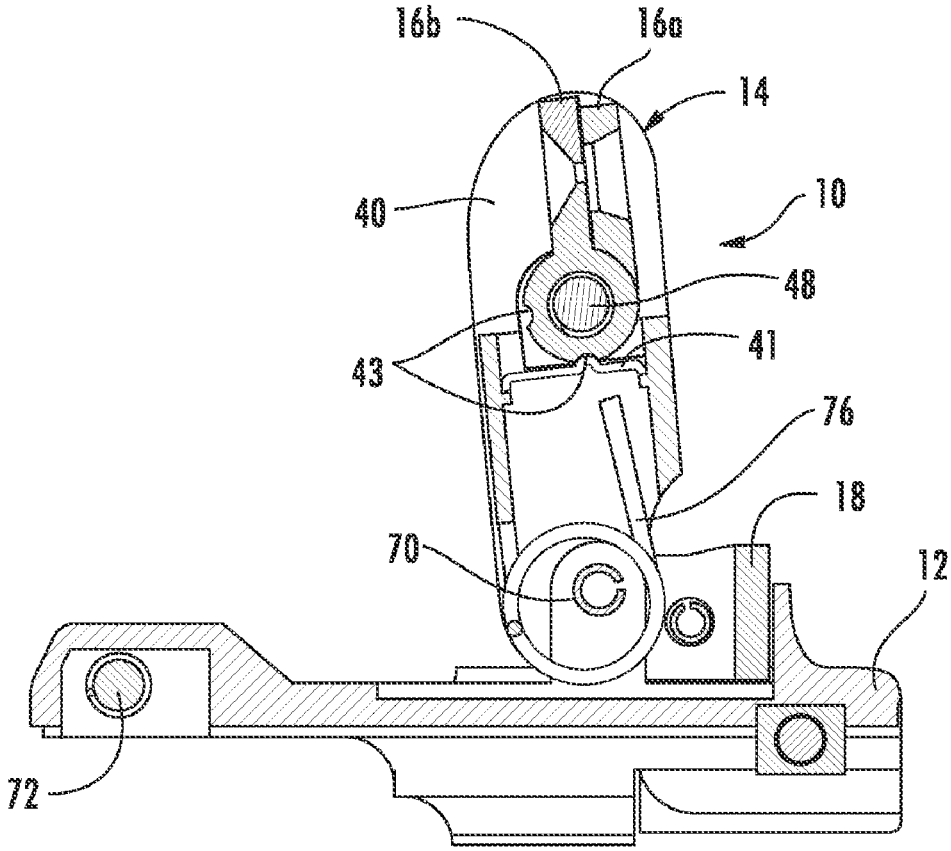
FIG. 3 is a cross-sectional view taken along the line 3-3 of FIG. 1.
Figure 3B:
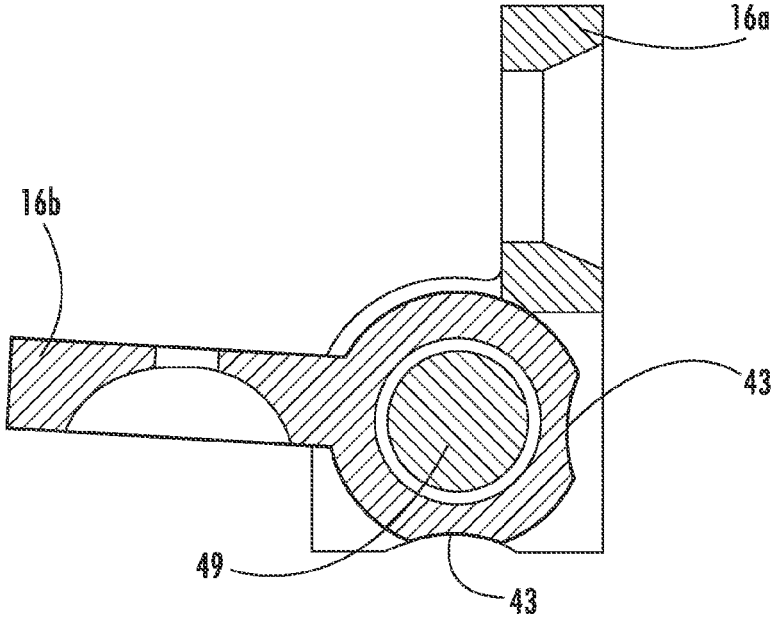
FIG. 3B is an enlarged cross-sectional view of the aiming elements with the second aiming element in the down (inactive) position.
Figure 3A:
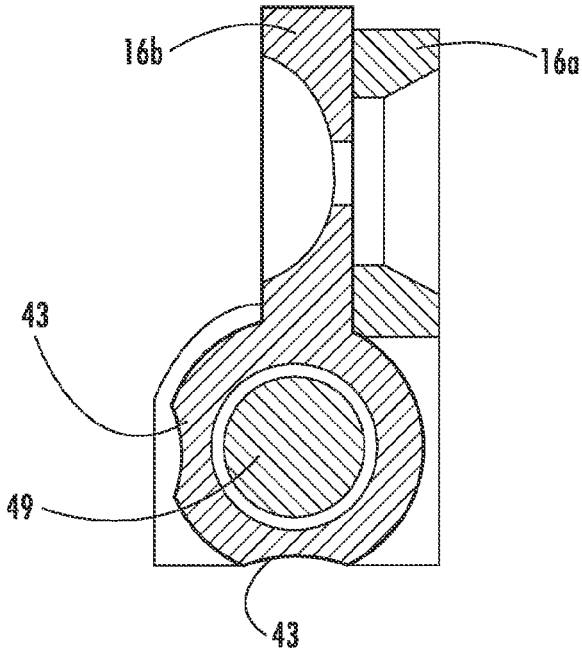
FIG. 3A is an enlarged cross-sectional view of the aiming elements with the second aiming element in the up (active) position.

As can best be seen in FIG. 3, a finger release clamp 72 is provided to hold the sight housing 14 in a retracted or down position against the base 12. The finger release clamp 14 engages a pin catch slot 74 formed in the catch plate 36 thereby holding the sight housing 14 in a normally closed first position. The finger release clamp 72 is mounted in a pin bore which is drilled into the base 12. A tension spring is also mounted in the pin bore thereby providing resistive force against rotation of the finger release clamp 72. A half-cylindrical notch is formed in the upper surface of the base 12. The purpose of the notch is to provide a place in the base for the clamp 72 to fold into, out of the way, when it is not holding the sight housing 14 in a down position. Another notch is formed in the rear of the catch plate 36. The purpose of this catch plate notch is to avoid damage to the sight housing 14 if it gets knocked down with great force into the clamp 72 which is partially protruding from the base notch.

Rotating the finger release clamp 72 away from the sight housing 14 disengages the finger release clamp 72 from the pin catch slot 74 and allows rotation of the sight housing 14 from the normally closed first position to the open second position. A torsional spring 76 urges the sight housing 14 from the closed first position to a vertical open second position. The torsional spring 76 surrounds the mounting spring pin 70 in the lower aperture 42 between the mounting tabs 34.

In this embodiment as can best be seen in referring to FIGS. 5 and 6, a self aligning feature is also provided within the aiming device 10 of the present invention. While the inclusion of this feature is not a critical component of the overall device of the present invention, its inclusion further enhances the overall performance of such a device. Accordingly, consistent vertical positioning of the sight housing 14 is accomplished with the aid of alignment chamfers 78, formed on the top edges of the vertical sides 52, 54 of the U-shaped alignment member 18. In this embodiment of the invention, the chamfer 78 slopes are at a forty-five degree angle and the longitudinal axes of the alignment chamfers 78 are substantially parallel to the longitudinal axis of the base 12. The sight housing 14 has corresponding alignment surfaces 44. When the sight housing 14 is released to the open second position, the alignment surfaces 44 are wedged against the alignment chamfers 78, respectively, bringing the sight housing 14 to rest in the same vertical position every time it is released. The slopes of the alignment surfaces 44 correspond to the slopes of the alignment chamfers 78. Repeatability is further ensured by the "squeezing" action of the alignment surface 44 and catch plate 36 against the U-shaped alignment member 18 vertical side toward the base mounting tab 34, and the corresponding "squeezing"

action of the alignment surface 44 and adjustment plate 38 against the U-shaped alignment member 18 vertical side toward the base mounting tab 34. This ensures repeated and accurate alignment of the U-shaped alignment member vertical sides during each movement of the sight housing 14 to the open, second position. It should also be appreciated that the alignment member 18 may be eliminated in favor of chamfering the tops of the tabs 34 thereby providing the same type of alignment action each time the sight housing 14 is deployed.

Figure 4:
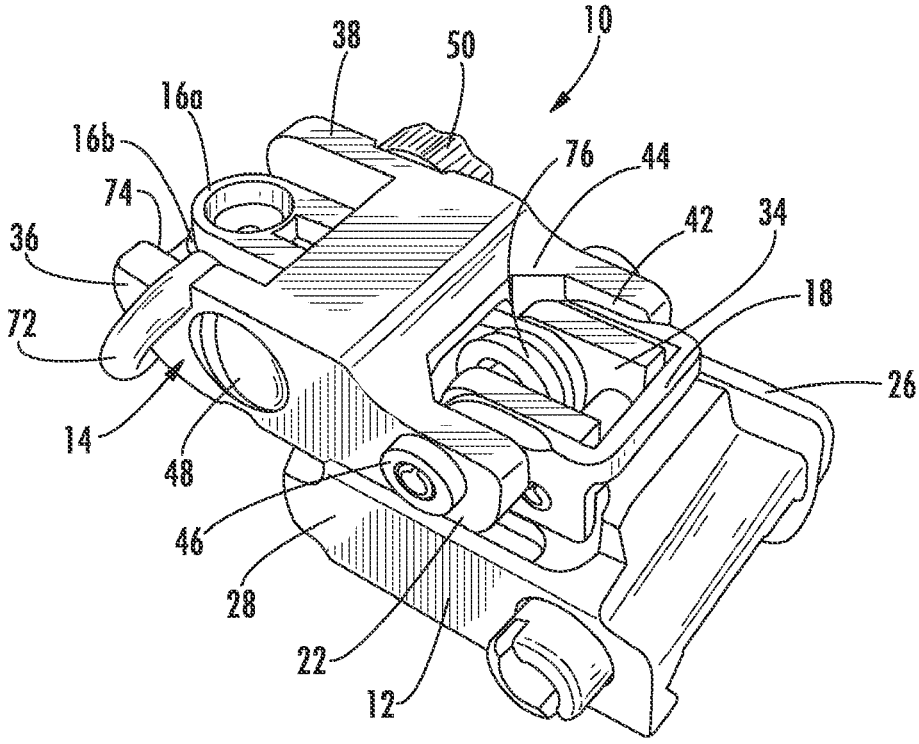
FIG. 4 is a perspective view of the flip up sight in the retracted position.

It should also be noted that when the sight housing 14 is in the retracted position, both of the aiming elements 16*a* and 16*b* are folded flat against one another and rest flat against the profile of the firearm 84. Further, the aiming elements 16*a* and 16*b* in this position are shielded by the catch plate 36 and the adjustment plate 38. As can be seen in FIG. 4, the sighting device 10 is shown as being integrated into a receiver rail 80 that is attached to the upper receiver 82 of a firearm 84. It can be seen that the sighting device 10 has a small and compact profile when placed in the retracted position. This can be contrasted with the prior art devices that utilized an L-shapes aiming element. In the prior art when the sight housing was in the retracted position, one of the legs of the aiming element projected outwardly from the firearm. This projection necessitated that the side walls of the sight housing be wider to provide protection for the projecting leg of the aiming element. In the present invention, with both aiming elements 16*a* and 16*b* folded flat against the contour of the firearm 84, the walls of the sight housing 14 can be narrower, providing a smaller overall profile depth allowing the sighting device 10 to reside in a more compact position against the firearm 84.

While the above-described embodiment uses a conventional firearm "iron" peep sight as the aiming elements 16, the principles of the present invention are also applicable to the newer optics sights currently becoming available, i.e., compact single optic frames with lens projected beam optics. The newer optics sights have a radial axis parallel to the transverse plane of the weapon and a central axis parallel to the longitudinal axis of the weapon. The newer optics sights have aiming optics which are quite flat along their central axis. The sights focus energy from illumination means on the flat aiming optics. The illumination means may be a laser, or other directed energy illuminator which directs energy onto the aiming lens. The present invention permits, for the first time, an ability to fold down aiming optics when not in use, and provides an ability to flip up the aiming optics to a preset configuration for actual use. Problems with the aiming optics being caught on clothing or brush when carried and knocked out of alignment from this contact or contact with other solid objects, are thereby eliminated. Accordingly, the basic sight apparatus is the same whether or not an "iron" aiming element is used or an optics sight is used.

It can therefore be seen that the present invention provides an improved sighting device 10 that has a smaller and more compact profile when placed into a storage position as compared to the sighting devices in the prior art. Further, the present invention can be modified to accommodate a number of different aiming elements 16 and can be integrated onto a variety of different firearms to provide a highly accurate low profile flip up sight for use in actual field conditions typically associated with combat weaponry. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A flip-up aiming sight for use with a firearm comprising:

a base member having a top surface and a bottom surface configured and arranged to be mounted on an upper receiver of a firearm;

a sight housing having an upper section and a lower section configured and arranged to be rotationally movable relative to said top surface of said base, said sight housing being rotationally movable relative to said base member between a first inactive position adjacent said base member and a second active position generally perpendicular to said base member, said upper section including upwardly extending, opposing sidewalls that cooperate to define a central support region, a spring received and retained between said base member and said sight housing for normally biasing said sight housing to said active position;

a retainer configured and arranged to selectively engage said sight housing and selectively retain said sight housing in said inactive position; and an aiming assembly mounted within said central support region of said upper section of said sight housing, said aiming assembly including a windage adjustment screw rotatably mounted between said upwardly extending opposing sidewalls, a first aiming element having a top aiming end and a bottom mounting end mounted on said windage adjustment screw, and a second aiming element having a top aiming end and a bottom mounting end mounted on said windage adjustment screw, said first aiming element being configured and arranged in a fixed upright position generally perpendicular to said central support region, said second aiming element being rotatably movable relative to said first aiming element between a first active position generally perpendicular to said central support region and parallel to said first aiming element and a second inactive position generally parallel to said central support region and perpendicular to said first aiming element, said first and second aiming elements being movable laterally along a shaft portion of said windage adjustment screw responsive to rotation of said windage adjustment screw.

2. The flip up aiming sight of claim 1 further comprising a spring seated beneath said first and second aiming elements, said spring engaging with spaced detents in said bottom mounting end of said second aiming element to selectively retain said second aiming element in said active and inactive positions.

3. The flip up aiming sight of claim 1 wherein said top aiming end of said first aiming element includes a first sighting aperture, and further wherein said top aiming end of said second aiming element includes a second sighting aperture having a smaller diameter than said first sighting aperture.

4. The flip up aiming sight of claim 2 wherein said top aiming end of said first aiming element includes a first sighting aperture, and further wherein said top aiming end of said second aiming element includes a second sighting aperture having a smaller diameter than said first sighting aperture.

* * * * *